United States Patent [19]

Kakar et al.

[11] 4,007,305

[45] Feb. 8, 1977

[54] METHOD OF IMPARTING NONDURABLE SOIL RELEASE AND SOIL REPELLENCY PROPERTIES TO TEXTILE MATERIALS

[75] Inventors: Sarwan K. Kakar, Southgate; Frank R. Kappler, Wyandotte; Gilbert S. Gomes, Southgate; John J. Cramer, Wyandotte, all of Mich.

[73] Assignee: BASF Wyandotte Corporation, Wyandotte, Mich.

[22] Filed: Dec. 23, 1974

[21] Appl. No.: 535,264

[52] U.S. Cl. ..... 427/322; 8/115.6; 252/8.6; 260/29.6 F; 427/390 E; 427/401; 428/265; 428/393; 428/395

[51] Int. Cl.$^2$ ..... B05D 3/00

[58] Field of Search ..... 427/401, 412, 402, 407, 427/390, 394, 395, 396, 322, 323, 324; 260/29.6 F, 29.4 UA; 428/264, 265, 392, 286, 393, 421, 395, 422, 507; 252/8.6; 8/115.6

[56] References Cited

UNITED STATES PATENTS

| | | | |
|---|---|---|---|
| 3,152,920 | 10/1964 | Caldwell et al. | 428/265 |
| 3,222,329 | 12/1965 | Grosse et al. | 8/115.6 |
| 3,377,249 | 4/1968 | Marco | 8/115.6 |
| 3,503,915 | 3/1970 | Peterson | 260/29.2 |
| 3,592,686 | 7/1971 | Barber et al. | 260/29.6 |
| 3,597,145 | 8/1971 | Marco | 8/115.6 |
| 3,598,514 | 8/1971 | Sello | 8/115.6 |
| 3,598,515 | 8/1971 | Moore et al. | 260/29.6 |
| 3,644,081 | 2/1972 | Matsuda et al. | 8/115.6 |
| 3,645,989 | 2/1972 | Tandy | 260/29.6 |
| 3,645,990 | 2/1972 | Raynolds | 260/29.6 |
| 3,654,244 | 4/1972 | Pittman et al. | 260/79.7 |
| 3,706,594 | 12/1972 | Wasley et al. | 428/264 |
| 3,782,898 | 1/1974 | Mandell | 8/137 |
| 3,798,169 | 1/1974 | Dickson et al. | 252/8.6 |
| 3,824,126 | 7/1974 | Katsushima et al. | 427/394 |

*Primary Examiner*—Ronald H. Smith
*Assistant Examiner*—Sadie L. Childs
*Attorney, Agent, or Firm*—Bernhard R. Swick; L. S. Van Landingham, Jr.; Robert E. Dunn

[57] ABSTRACT

Textile materials are treated with an alkaline aqueous medium having a pH value of 7.5–11 and containing 0.25–4% by weight of a dissolved water soluble hydrophilic soil release polymer having carboxylic acid groups and 0.05–1% by weight of a dispersed hydrophobic soil repellent fluorochemical. The soil release polymer and the soil repellent fluorochemical are deposited on the surfaces of the textile fibers and the resulting textile material is dried to impart the desired nondurable soil release and soil repellency properties. The aqueous medium also may contain polyvinylpyrrolidone to further improve the finish. In a preferred variant, the textile material is first contacted with an alkaline aqueous solution of the soil release polymer, and thereafter with an alkaline aqueous medium containing the dispersed soil repellent fluorochemical to reduce the tendency of the deposited soil release polymer to cover the deposited soil repellent fluorochemical molecules. A method of laundering soiled textile material is also provided wherein the washed and rinsed textile material is treated in accordance with the aforementioned method to impart nondurable soil release and soil repellency properties. The treated textile material is provided as a novel product.

15 Claims, No Drawings

METHOD OF IMPARTING NONDURABLE SOIL RELEASE AND SOIL REPELLENCY PROPERTIES TO TEXTILE MATERIALS

THE BACKGROUND OF THE INVENTION

1. Field of the Invention

The present invention is concerned with a novel method of imparting nondurable soil release and soil repellency properties to textile materials. In one variant, the invention is concerned with a method of laundering soiled textile materials wherein the washed and rinsed textile material is thereafter treated to impart nondurable soil release and soil repellency properties. The invention further provides the improved textile material prepared by the method of the invention.

2. Prior Art

Natural textile fibers such as cotton and wool exhibit no soil repellency properties in the untreated state. However, the fibers are hydrophilic and water swellable and have excellent soil release properties when washed in an aqueous alkaline medium containing a detergent. Thus, while natural cotton and wool fibers are easily soiled, they are also easily cleaned.

Manmade textile fibers, on the other hand, are hydrophobic in nature and exhibit no soil release or soil repellency properties in the untreated state. As a result, textile fibers such as polyesters, rayon and nylon soil easily and are difficult to clean once soiled due to the lack of satisfactory soil release properties. The manmade fibers present a severe problem with respect to effective laundering and the problem is especially pronounced with blends of polyester and cotton fibers. When an oil stain such as motor oil impinges upon the surface of the resulting fabric, surface interaction forces and capillary forces tend to disperse the oil stain. Microscopic observations reveal that the oil stain coats the surfaces of the textile fibers throughout the soiled area. Elevated temperature is very detrimental as the oil molecules are forced deep into the polymer matrix and the resulting soiled fabrics are almost impossible to clean.

The surface characteristics of both manmade and natural textile fibers have been modified heretofore by applying various types of soil release or soil repellent finishes. When a particular type of finish is applied, a new solid surface is formed on the textile fibers. Intrinsic interaction between the fibers and the staining substance no longer exists as new interaction forces between the applied finish and the stain predominate. By applying a continuous film of a hydrophilic water swellable polymer over the normally hydrophobic surfaces of manmade fibers, the resulting fiber surfaces are rendered hydrophilic and water swellable when laundered and the soil is released effectively. Thus, the soiled manmade fabric regains its original appearance after a single washing.

Another approach to the laundering problem has been to impart soil repellency properties to the textile fibers and thereby prevent or reduce soiling in the first instance. A number of soil repellent finishes have been proposed heretofore. The most effective soil repellent finishes are usually fluorochemical finishes of the types sold under tradenames such as Zepel-B, F.C. 208, and ACTM. The fluorochemical finishes impart good oil and water repellency properties to both natural and manmade textile fibers. The oleophobicity and hydrophobicity properties imparted by the conventional fluorocarbon finishes may be attributed to the surface energy caused by close packing of the fluoro groups at the fiber interfaces. Textile fibers coated with a soil repellent fluorocarbon finish are hydrophobic in nature and exhibit very poor or no soil release properties. While the soil repellent finishes are effective in repelling soil and reduce the frequency of laundering, nevertheless once soiled the fabric is very difficult to launder.

A number of attempts have been made to overcome the soil release deficiencies of the fluorocarbon finishes. One approach to the problem was to use a fluorochemical which has a hydrophobic soil repellent fluorocarbon moiety and a hydrophilic soil release moiety incorporated in a single molecule or molecular chain.

While these recently developed fluorochemical finishes have met with some degree of success, nevertheless they do have deficiencies when applied in accordance with prior art processes. The fluorochemicals are expensive and heretofore had to be applied to the fabric in relatively large amounts to impart effective soil repellent properties As a result, the prior art has concentrated its efforts on the application of durable soil repellent finishes. The soil repellent properties diminish with each laundering and thus the fluorochemical does not provide optimum protection after the initial washing and eventually becomes ineffective. The soil release properties likewise diminish with each laundering and eventually the fabric cannot be laundered effectively.

Satisfactory nondurable finishes which impart optimum soil release and soil repellent properties have not been available heretofore. One deterrent was the high costs of application by the prior art processes and the fact that the finish is largely removed with each laundering. If a nondurable soil release and soil repellent finish is to be commercially acceptable it should be capable of being applied at low cost and it should provide optimum soil release and soil repellency properties throughout its lifespan. A suitable nondurable finish of this type was not available heretofore in spite of the advantages thereof over the durable type of finishes which are characterized by diminished effectiveness with age.

THE SUMMARY OF THE INVENTION

The present invention provides a highly effective nondurable soil release and soil repellent finish for both manmade and natural textile fibers which may be applied at low cost. The textile materials are treated with a synergistic combination of a soil release polymer and a soil repellent fluorochemical which requires less of the expensive fluorochemical. In practicing the method, the textile fibers are intimately contacted with an alkaline aqueous medium containing a dissolved water soluble hydrophilic soil release polymer having carboxylic acid groups and a dispersed hydrophobic soil repellent fluorochemical in the presence or absence of polyvinylpyrrolidone to further improve the finish. Preferably, the soil repellent properties are further enhanced by applying the soil release polymer first and thereafter the soil repellent fluorochemical. The invention further provides a novel method of laundering soiled textile materials wherein nondurable soil release and soil repellency properties are imparted to the washed and rinsed textile material. The method of the invention also provides a novel textile material which is characterized by a unique combination of nondurable soil release and soil repellency properties.

The detailed description of the preferred variants of the invention and the specific examples appearing hereinafter may be referred to for a more complete and comprehensive understanding of the invention.

THE DETAILED DESCRIPTION OF THE INVENTION INCLUDING PREFERRED VARIANTS AND EMBODIMENTS THEREOF

In accordance with one presently preferred variant of the present invention, nondurable soil release and soil repellency properties are imparted to textile materials by intimately contacting the same with an alkaline aqueous medium containing a dissolved water soluble hydrophilic soil release polymer containing carboxylic acid groups and a dispersed hydrophobic soil repellent fluorochemical finish. In accordance with a further preferred variant of the invention, the textile materials are first intimately contacted with an aqueous alkaline solution of the soil release polymer, and thereafter with an aqueous medium containing dispersed soil repellent fluorochemical. In each instance, the textile material is then dried. As will be described more fully hereinafter, there are certain preferred variants which produce improved results. All quantities mentioned herein are calculated on a weight basis unless indicated to the contrary.

The soil release polymer must be hydrophilic, water soluble and contain carboxylic acid groups in the free acid or neutralized form. Polymers of this type may be prepared from polymerizable unsaturated organic acids and the anhydrides thereof. The polymers may be homopolymers of the acid, or copolymers of the acid with one or more other ethylenically unsaturated monomers which are copolymerizable therewith. Specific examples of polymerizable acids include acrylic acid, methacrylic acid, maleic acid, fumaric acid, itaconic acid, crotonic acid, cinnamic acid and the like. Maleic anhydride is usually a preferred acid anhydride but other acid anhydrides may be used. Monomers copolymerizable therewith include esters of the foregoing acids prepared by reacting the acid with an alkyl alcohol containing, for example, 1–8 and preferably 1–4 carbon atoms, such as methyl, ethyl, propyl, isopropyl, n-butyl and isobutyl acrylate, methacrylate, fumarate, maleate, crotonate and cinnamate, acrylonitrile, and ethylenically unsaturated alcohols such as allyl alcohol and homologues thereof preferably containing up to about 10 carbon atoms.

Especially preferred soil release polymers include polyacrylic acid, copolymers of acrylic acid and maleic anhydride, copolymers of acrylic acid, n-butyl acrylate and allyl alcohol, copolymers of acrylic acid and n-butyl acrylate, copolymers of methacrylic acid and ethyl acrylate, alginic acid, carboxymethyl cellulose including both low and high substitutions, admixtures of polyacrylic acid with copolymers of acrylic acid, n-butyl acrylate and allyl alcohol, admixtures of polyacrylic acid with copolymers of methyl acrylic acid and ethyl acrylate, and copolymers of methyl vinyl ether and maleic anhydride. Admixtures of two or more of the foregoing polymers may produce preferred results in many instances. The best results are usually obtained with copolymers of methyl vinyl ether and maleic anhydride.

The soil release polymers should contain a high percentage of carboxylic acid groups for best results. As a general rule, the polymers should contain more than 20% of the ethylenically unsaturated acid in polymerized form, and preferably more than 40%. Homopolymers of ethylenically unsaturated acids such as acrylic acid and methacrylic acid are very satisfactory and thus the ethylenically unsaturated acid may be present in amounts up to 100%. In instances where copolymers are prepared, usually the ethylenically unsaturated acid should be present in an amount of about 40–60% and preferably about 50%. The resulting soil release polymers are water soluble and are capable of being deposited on the surfaces of the textile fibers from an alkaline aqueous medium. The molecular weight is usually less than 50,000 and is preferably about 10,000–30,000.

The soil repellent fluorochemical finish may be a prior art substance used for this purpose. Suitable examples include fluorochemical finishes sold under the tradenames Zepel-B, Scotchguard, FC 208, and A.C.T.M. Preferably, the fluorochemical is either a fluorocarbon or it contains fluorocarbon side chains or substituents. Other examples of fluorochemical soil repellents are set forth in an article by E. G. Higgins entitled "Finishing for Water Repellency," Textile institute and Industry, September, 1966, pages 255–257. The teachings of this article are incorporated herein by reference. As a general rule, fluorochemicals containing one or more perfluoro groups per molecule are preferred. Still further examples of soil repellent fluorochemical finishes are disclosed in U.S. Pat. Nos. 3,503,915, 3,547,861, 3,592,686, 3,597,145, 3,600,433, 3,654,244, 3,668,233, 3,699,156, 3,645,989, 3,733,357 and 3,786,089, the disclosures of which are incorporated herein by reference.

The alkaline aqueous medium which is contacted with the textile material may contain about 0.25–4% of the soil release polymer, and preferably about 0.5–2%. The best results are usually achieved with about 1% of the soil release polymer.

The soil repellent fluorochemical may be present initially in the aqueous medium containing the soil release polymer, or it may be added thereto after the textile fibers are treated with the soil release polymer. In either instance, the fluorochemical is dispersed in the aqueous medium in an amount of about 0.05–1%, and preferably about 0.1–0.5%. The best results are usually achieved with about 0.2% of the fluorochemical.

The alkaline aqueous medium also may contain a nitrogen-bearing polymeric chelating agent such as water soluble polyvinylpyrrolidone. The polyvinylpyrrolidone may be present in an amount of about 0.05–1% and preferably about 0.1–0.5%. The best results are usually achieved with about 0.25% polyvinylpyrrolidone.

The quantity of alkaline aqueous medium contacted with the textile fibers may vary over wide ranges and may be, for example, 1–100 times the weight of the fabric. Much higher quantities may be used but usually are not necessary. The excess aqueous medium may be removed from the treated textile material after being in intimate contact therewith over a period of time sufficient for the soil release polymer and the soil repellent fluorochemical to be deposited thereon. Usually periods of treatment of about 5 minutes to one hour and preferably about 10 to 30 minutes are satisfactory.

The pH of the alkaline aqueous medium may be about 7.5–11, and is preferably about 7.8–8. Suitable bases which may be added to arrive at the desired pH range include ammonium hydroxide, sodium hydroxide and potassium hydroxide.

Treatment of the textile material with the alkaline aqueous medium results in the deposition on the surfaces of the fibers of a soil release finish comprising the soil release polymer. Additionally, a soil repellent finish comprising the fluorochemical is deposited on the surfaces of the fibers. Thereafter, the textile material may be dried at any suitable temperature such as from room temperature up to about 250° F. Usually a drying temperature of approximately 200°–225° F is preferred. The drying is continued until the water is largely removed from the wet textile material and overdrying should be avoided.

It is usually preferred that at least a portion of the soil release polymer be deposited on the fiber surfaces prior to deposition of the soil repellent fluorochemical. Following this procedure reduces the tendency of the soil release polymer to cover the initially deposited fluorochemical molecules. In instances where the fluorochemical molecules are covered by the soil release polymer, they are not as effective as a soil repellent and thus more of the fluorochemical is required.

The method of the invention is especially useful in laundering soiled textile materials wherein nondurable soil release and soil repellency properties are imparted to the freshly laundered textile. In practicing this variant of the invention, the soiled textile is washed in water containing a detergent following prior art procedures whereby the soil is removed. The wash water containing the detergent and suspended soil is separated and the textile is rinsed with fresh water to remove the residual detergent and soil. The rinsed textile is hydroextracted and thereafter the soil release and soil repellent finishes are applied in accordance with the method previously described.

The fibers of the treated textile material have the soil release polymer and the soil repellent fluorochemical deposited thereon in an amount sufficient to impart the desired degree of soil release and soil repellent properties. The amounts may be in accordance with prior art practices if desired.

The foregoing detailed description and the following specific examples are for purposes of illustration only, and are not intended as being limiting to the spirit or scope of the appended claims.

EXAMPLE I

This Example illustrates the preparation of water soluble hydrophilic soil release polymers for use in practicing the invention. The monomer or monomer mixtures which were polymerized are as follows:

1. 80 grams of acrylic acid, 10 grams of n-butyl acrylate and 10 grams of allyl alcohol;
2. 80 grams of acrylic acid and 20 grams of n-butyl acrylate;
3. 80 grams of methylacrylic acid and 20 grams of ethyl acrylate; and
4. Glacial acrylic acid.

The monomer or monomer mixtures to be polymerized were placed in a separatory funnel. In instances where more than one monomer was present, the monomers were mixed thoroughly prior to use. Potassium persulfate in an amount of 1.6 grams was dissolved in 100 milliliters of distilled water and poured into another separatory funnel. Distilled water in an amount of 200 grams was added to a 3-necked flask fitted with a stirrer. The temperature of the ingredients in the flask was maintained at 72°–75° F during polymerization. The rate of flow of the monomer or monomer mixture and the potassium persulfate solution was adjusted so that 45 minutes was required to drop the contents of the two separatory funnels into the flask. A 5° to 6° rise in temperature was noted as the polymerization progressed. After 2 hours, steam was blown into the flask to remove residual monomers. The viscous solution remaining in the flask contained approximately 25% of solids in the form of the corresponding polymer or copolymer.

The above general procedure was used in the polymerization of the above four specific monomers or monomeric mixtures. Other acrylic acid or methylacrylic acid polymers or copolymers may be prepared following the same procedure. The average molecular weight of the polymer produced in the above polymerizations was between 10,000 and 30,000. The resulting polymers were used in experiments appearing hereinafter.

EXAMPLE II

This Example illustrates the preparation of five stains for use in soiling fabrics to be tested in accordance with the invention. The cleanability ratings in the following Experiments wherein the stains were used are based upon the Dearing Milliken Research Corporation soil release chart. The stains were prepared in accordance with the instructions for the soil release chart.

The five stains were prepared as follows:

Stain No. 1

Stain No. 1 was used crankcase oil meeting the standardization criteria of the soil release chart. The oil was obtained from a service garage.

Stain No. 2

Stain No. 2 was prepared from 200 grams of used crankcase oil of the type described in Stain No. 1, 25 grams of multi-purpose grease (polysulfide), and 25 grams of Xylol (reagent grade). These ingredients were mixed well in a blender prior to use.

Stain No. 3

Stain No. 3 was prepared from 300 grams of used crankcase oil of the type described in Stain No. 1, and 20 grams of heavy flux grease (unblown asphalt base grease). These ingredients were mixed well in a blender prior to use.

Stain No. 4

Stain No. 4 was prepared from 300 grams of the used crankcase oil described in Stain No. 1, and 25 grams of an alkaline earth metal multi-purpose grease (Shell Darina E.P. Grease No. 2). These ingredients were mixed well in a blender prior to use.

Stain No. 5

Stain No. 5 was prepared from 100 grams of 10% colloidal graphite and 20 grams of Xylol (reagent grade). These ingredients were mixed well in a beaker with a stirring rod.

The above five stains were used in the Examples appearing hereinafter.

EXAMPLE III

This Example illustrates the treatment of polyester-cotton fabrics with a fluorochemical only.

The fluorochemical used in this and subsequent Examples is sold by CIBA-GEIGY Corporation under its tradename Tinotop T-20. The fluorochemical is a derivative of a fumarate monomer. Tinotop T-20 contains about 7% of combined fluorine and is 25–29% solids. Of this solids content, 61.75% is the fluorochemical polymer, 9.55% is wax, and 28.7% is water. The fluorine content of the solids portion is 24.34%. Tinotop T-20 has a closed cup flask point of 72° F. and it contains 13% acetone. The fluorochemical content in this example and in the examples appearing hereinafter is given on a dry solids basis.

Swatches of 50—50 polyester-cotton (4 × 4 inches) were dipped in an aqueous dispersion of Tinotop T-20 containing the fluorocarbon in amounts varying from 0.15 to 0.6%. The textile material to aqueous dispersion ratio was 1:10. After 10 minutes, the swatches were removed from the aqueous dispersion, squeezed to give a wet pickup of 65–75%, and then dried in an oven at 210° F. The dried swatches were pressed and stained with two drops of Stain No. 1 of Example II. The soiled swatches were kept for 2 hours at room temperature, and then washed with a wash formula containing 0.05% of nonionic detergent, 0.15% of kerosene or cyclic hydrocarbon, and 2% of soda ash. The cleanability ratings were determined in accordance with the Deering Milliken Research Corporation soil release chart. The data are given below in Table I.

Table I

| % by weight of fluorochemical in the aqueous dispersion | Cleanability rating |
|---|---|
| 0.15 | 2 |
| 0.30 | 2 |
| 0.45 | 3 |
| 0.60 | 3.5–4 |
| 0.75 | 2.5–1 |
| untreated | 1 |

From the above data, it may be seen that a minimum of 0.60% by weight of the fluorochemical is necessary to give satisfactory cleanability ratings on 50—50 polyester-cotton blends.

Additional runs were made on 4 × 4 inches swatches of 65–35 polyester-cotton swatches under the conditions set out above. The data thus obtained are given below in Table II.

Table II

| Stain No. | Treatment with 0.6% by weight fluorochemical | Untreated |
|---|---|---|
| 1 | 2.5–3 | 1 |
| 2 | 2 | 1 |
| 3 | 2 | 1 |
| 4 | 2 | 1 |
| 5 | 2 | 1 |

It may be seen from the data in Table II that increasing the polyester-cotton ratio from 50—50 to to 65—35 resulted in poor cleanability ratings.

EXAMPLE IV

This Example illustrates the treatment of polyester-cotton fabrics with a combination of a fluorochemical and the hydrophilic water soluble soil release polymers of the invention.

Swatches (4 × 4 inches) of 65—35 polyester-cotton were dipped in an aqueous alkaline treating composition having a pH of 9–11 containing 1.3% by weight of the copolymer of acrylic acid/n-butyl alcohol/allyl alcohol prepared by Example I, 0.07–0.6% by weight of fluorochemical (Tinotop T-20), and the balance water. Wet pickup amounted to about 65% after squeezing the swatches. The swatches were dried in an oven at 220° F, and then soiled with multistain oils as prepared in Example II for hourly periods of 4, 12, 48, 72 and 168 hours. The swatches were washed for 20 minutes in water containing 20 grams per liter of soda ash and 20 grams per liter of nonionic detergent/trichloroethylene in proportions of 50—50 by weight. This was followed by washing in water containing 0.5 gram per liter of soap and 20 grams per liter of anhydrous borax.

The cleanability ratings as determined by the Deering Milliken Research Corporation soil release chart are given below in Table III.

Table III

| Period of Soiling | Cleanability Ratings for Stains 1–5 | | | | |
|---|---|---|---|---|---|
| | No. 1 | No. 2 | No. 3 | No. 4 | No. 5 |
| 4 hours | 4 | 4 | 4 | 5 | 4 |
| 12 hours | 4 | 4 | 4 | 5 | 3.5 |
| 48 hours | 4 | 4 | 4 | 5 | 3.5 |
| 72 hours | 4 | 4 | 4 | 4 | 3 |
| 168 hours | 4 | 4 | 4 | 4.5 | 2.5 |

It may be observed from the data in Table II and Table III that the cleanability ratings were greatly improved when the fluorocarbon was used in combination with a soil release polymer of the invention.

EXAMPLE V

This Example illustrates the use of a mixture of soil release polymers of the invention in combination with a fluorochemical. The general procedure followed in this Example was the same as in Example IV with the exception of substituting the treating formulations set out below for that of Example IV.

The three treating formulations used in this Example are set out below:

Formulation A

Formulation A contains the fluorochemical (Tinotop T-20 ) in an amount of 0.075% by weight, polyacrylic acid in an amount of 1.3% by weight, and the copolymer of acrylic acid/n-butyl acrylate/allyl alcohol prepared in Example I in an amount of 0.65% by weight.

Formulation B

Formulation B contained 0.075% by weight of the fluorochemical (Tinotop T-20), 1.3% by weight of polyacrylic acid, and 0.65% by weight of the copolymer of acrylic acid/n-butyl acrylate prepared in accordance with Example I.

Formulation C

Formulation C contained 0.075% by weight of the fluorochemical (Tinotop T-20) 1.3% by weight of polyacrylic acid, and 0.65% by weight of the copolymer of methyl acrylic acid/ethyl acrylate prepared in accordance with Example I.

The soil release ratings as determined by the Deering Milliken Research Corporation soil release chart appear below in Table IV. All three formulations received the same rating in each instance.

Table IV

| Period of Soiling | Soil Release Ratings | | | | |
|---|---|---|---|---|---|
| | Stain No. 1 | Stain No. 2 | Stain No. 3 | Stain No. 4 | Stain No. 5 |
| 4 hours | 5 | 5 | 5 | 5 | 5 |
| 12 hours | 5 | 5 | 5 | 5 | 5 |
| 48 hours | 5 | 5 | 5 | 5 | 5 |
| 72 hours | 5 | 5 | 5 | 5 | 5 |
| 168 hours | 5 | 5 | 5 | 5 | 4.5 |

It may be noted from the data in Table IV above that excellent soil repellency may be obtained when the fluorochemical concentration in the treating composition is reduced to only 0.075%.

EXAMPLE VI

This Example illustrates the testing of additional formulations containing a soil release polymer and a fluorochemical in accordance with the teaching of the invention. The general procedure was the same as that set out in Example IV.

The formulations tested in this Example are set out in Table V below.

Table V

| Ingredient | Compositions of Finishes | | | | | | | | |
|---|---|---|---|---|---|---|---|---|---|
| | A | B | C | D | E | F | G | H | I |
| Polyacrylic acid | 2.5 | 2.5 | | | | | | | |
| Polyacrylic acid/ maleic anhydride | | | 2.0 | | | | | | |
| Polymethyl vinyl ether/maleic anhydride | | 0.3 | | 1.0 | 1.0 | | | | |
| Alginic acid | | | | | | 0.5 | 0.5 | | |
| Carboxylic methyl cellulose (Least Substituted) | | | | | | | | 0.5 | |
| Carboxylic methyl cellulose (Fully substituted) | | | | | | | | | 0.5 |
| Oleic acid | 1.0 | | | | 1.0 | | 1.0 | | |
| Polyvinyl-pyrrolidone | | 0.15 | 0.15 | 0.25 | 0.25 | | | | |
| Fluorochemical | 0.15 | 0.15 | 0.15 | 0.15 | 0.15 | 0.15 | 0.15 | 0.15 | 0.15 |

The soil release ratings for the finish compositions appearing in Table V are given in Table VI below.

Table VI

| Finish composition | Soil Release Ratings for Stains 1–5 | | | | |
|---|---|---|---|---|---|
| | 1 | 2 | 3 | 4 | 5 |
| A | 5 | 5 | 5 | 5 | 5 |
| B | 5 | 5 | 5 | 5 | — |
| C | 5 | 5 | 5 | 5 | 5 |
| D | 5 | 4.5 | 5 | 4.0 | — |
| E | 5 | 5 | 5 | 5 | 5 |
| F | 5 | 5 | 5 | 5 | 5 |
| G | 5 | 5 | 4.5 | 5 | — |
| H | 5 | 5 | 5 | 5 | 5 |
| I | 5 | 4 | 5 | 4.5 | — |

From the data appearing in Table VI above, it may be noted that very satisfactory cleanability ratings were obtained for all of the finish compositions. The fluorochemical used in this example was Tinotop T-20.

EXAMPLE VII

This Example illustrates the method of the invention for laundering soiled textile materials and then imparting a soil release and soil repellent finish to the resulting cleaned textile materials.

Soiled clothing was washed in a 100 pound Milnor washer in water containing a detergent following the generally recommended prior art washing procedure. The wash water containing soil and detergent was extracted from the clothing, and then the clothing was rinsed four times in fresh water. Following the last rinse, the clothing was substantially free of residual detergent and soil and the clothing was hydroextracted for 2–3 minutes to remove the rinse water.

At this point, the switches on the washer were set at automatic, the motor was stopped, and the water level was set at the minimum, i.e., a weight ratio of textile to water of 1:2 which for a full load is 200 pounds of water. Then 25 pounds of a soil release formulation containing 86 parts of water, 8 parts of water soluble hydrophilic polymethylvinyl ether-maleic anhydride copolymer (50—50 mole ratio), 4 parts of sodium hydroxide and 2 parts of polyvinylpyrrolidone were added to the washer and admixed with the washed clothing for approximately 10 minutes. Thereafter, 2.5 pounds of Tinotop T-20 were added to the soil release formulation and admixed with the clothing. This is 2.5 pounds of an aqueous dispersion containing 0.38 pound of soil repellent fluorochemical. The washer motor was restarted and the clothing was treated with agitation for about 15–20 minutes. The treated clothing was hydroextracted for about 10 seconds and then dried in a tumbler dryer until slightly damp. The dried clothing could be steamed or pressed by conventional equipment. Upon testing following the procedure set out in Example IV, it was found that excellent nondurable soil release and soil repellent properties were imparted to the dried treated clothing. Thus, the method of the invention for imparting soil release and soil repellent properties to fabrics may be easily combined with a laundering step.

We claim:

1. A method of imparting nondurable soil release and soil repellency properties to textile material including textile fibers comprising the steps of intimately contacting the fibers of the said textile material with an alkaline aqueous medium containing as the essential ingredients for imparting the said nondurable soil release and repellency properties (a) a dissolved water soluble hydrophilic soil release polymer containing carboxylic acid groups whereby a soil release finish comprising the said soil release polymer is deposited on the surfaces of the fibers, (b) a dispersed hydrophobic soil repellent fluorochemical finish whereby a soil repellent finish comprising the said fluorochemical is deposited on the surfaces of the fibers, and (c) water soluble polyvinylpyrrolidone, the said aqueous medium having a pH value of about 7.5–11 and containing about 0.25–4% by weight of the soil release polymer, about 0.05–1% by weight of the soil repellent fluorochemical, and about 0.05–1% by weight of the water soluble polyvinylpyrrolidone, and drying the textile material having the said soil release polymer and the said soil repellent fluorochemical deposited on the fibers thereof to produce a dry textile material having nondurable soil release and soil repellency properties.

2. The method of claim 1 wherein the said aqueous medium also contains about 0.1–0.5% by weight of water soluble polyvinylpyrrolidone.

3. The method of claim 1 wherein the said soil release polymer is a copolymer of methyl vinyl ether and maleic anhydride.

4. A method of imparting nondurable soil release and soil repellency properties to textile material including textile fibers comprising the steps of intimately contacting the fibers of the said textile material with an alkaline aqueous solution of water soluble hydrophilic soil release polymer containing carboxylic acid groups and water soluble polyvinylpyrrolidone to deposit a soil release finish comprising the said soil release polymer on the surfaces of the fibers, the said soil release polymer being selected from the group consisting of (1) polyacrylic acid, (2) copolymers of acrylic acid and maleic anhydride, (3) copolymers of acrylic acid, n-butyl acrylate and allyl alcohol, (4) copolymers of acrylic acid and n-butyl acrylate, (5) copolymers of methyl acrylic acid and ethyl acrylate, (6) alginic acid, (7) carboxy methyl cellulose, (8) admixtures of polyacrylic acid with copolymers of acrylic acid, n-butyl acrylate and allyl alcohol, (9) admixtures of polyacrylic acid with copolymers of methyl acrylic acid and ethyl acrylate, and (10) copolymers of methyl vinyl ether and maleic anhydride, the said aqueous solution having a pH value of about 7.5–11 and containing about 0.25–4% by weight of the said soil release polymer and about 0.05–1% by weight of the water soluble polyvinylpyrrolidone as the essential ingredients for imparting the said nondurable soil release property to the textile material, thereafter intimately contacting the fibers of the said textile material with an aqueous medium containing dispersed hydrophobic soil repellent fluorochemical finish to deposit a soil repellent finish comprising the soil repellent fluorochemical on the surfaces of the fibers, the soil repellent fluorochemical having at least one perfluoro group and being dispersed in the aqueous medium in an amount of about 0.05–1% by weight, and thereafter drying the textile material to produce dry textile material having nondurable soil release and soil repellency properties.

5. The method of claim 4 wherein the said aqueous solution contains about 0.5–2% by weight of the soil release polymer and about 0.1–0.5% by weight of the polyvinylpyrrolidone, and the said aqueous medium contains about 0.1–0.5% by weight of the soil repellent fluorochemical.

6. The method of claim 5 wherein the said aqueous solution contains about 1% by weight of the soil release polymer and about 0.25% by weight of the water soluble polyvinylpyrrolidone, and the said aqueous medium contains about 0.2% by weight of the soil repellent fluorochemical.

7. The method of claim 4 wherein the said soil release polymer is a copolymer of methyl vinyl ether and maleic anhydride.

8. A method of laundering soiled textile material including textile fibers and imparting nondurable soil release and soil repellency properties to the resulting laundered textile material comprising the steps of washing the soiled textile material in water containing a detergent to remove soil, separating wash water containing soil and detergent from the textile material, rinsing the textile material with water to remove residual wash water and detergent, separating rinse water from the textile material, and thereafter intimately contacting the fibers of the resulting washed textile material with an alkaline aqueous medium containing as the essential ingredients for imparting the said nondurable soil release and repellency properties (a) a dissolved water soluble hydrophilic soil release polymer containing carboxylic acid groups whereby a soil release finish comprising the said soil release polymer is deposited on the surfaces of the fibers, (b) a dispersed hydrophobic soil repellent fluorochemical finish whereby a soil repellent finish comprising the said fluorochemical is deposited on the surfaces of the fibers, and (c) water soluble polyvinylpyrrolidone, the said aqueous medium having a pH value of about 7.5–11 and containing about 0.25–4% by weight of the soil release polymer about 0.05–1% by weight of the soil repellent fluorochemical, and about 0.05–1% by weight of the water soluble polyvinylpyrrolidone, and drying the textile material having the said soil release polymer and the said soil repellent fluorochemical deposited on the fibers thereof to produce dry textile material having nondurable soil release and soil repellency properties.

9. The method of claim 8 wherein the said aqueous medium contains about 0.5–2% by weight of the soil release polymer about 0.1–0.5% by weight of the polyvinylpyrrolidone, and about 0.1–0.5% by weight of the soil repellent fluorochemical.

10. The method of claim 8 wherein the said aqueous medium contains about 1% by weight of the soil release polymer, about 0.25% by weight of the polyvinylpyrrolidone, and about 0.2% by weight of the soil repellent fluorochemical.

11. The method of claim 8 wherein the said soil release polymer is a copolymer of methyl vinyl ether and maleic anhydride.

12. A method of laundering soiled textile material including textile fibers and imparting nondurable soil release and soil repellency properties to the resulting laundered textile material comprising the steps of washing the soiled textile material in water containing a detergent to remove soil, separating wash water containing soil and detergent from the textile material, rinsing the textile material with water to remove residual wash water and detergent, separating rinse water from the textile material, and thereafter intimately contacting the fibers of the resulting washed textile material with an alkaline aqueous solution of water soluble hydrophilic soil release polymer containing carboxylic acid groups and water soluble polyvinylpyrrolidone to deposit a soil release finish comprising the said soil release polymer on the surfaces of the fibers, the said aqueous solution having a pH value of about 7.5–11 and containing about 0.25–4% by weight of the said soil release polymer and about 0.05–1% by weight of the water soluble polyvinylpyrrolidone as the essential ingredients for imparting the said nondurable soil release property to the textile material, thereafter intimately contacting the fibers of the said textile material with an aqueous medium containing dispersed hydrophobic soil repellent fluorochemical finish to deposit a soil repellent finish comprising the soil repellent fluorochemical on the surfaces of the fibers, the soil repellent fluorochemical being dispersed in the aqueous medium in an amount of about 0.05–1% by weight, and thereafter drying the textile material to produce dry textile material having nondurable soil release and soil repellency properties.

13. The method of claim 12 wherein the said aqueous solution contains about 0.5–2% by weight of the soil release polymer and about 0.1–0.5% by weight of the polyvinylpyrrolidone, and the said aqueous medium contains about 0.1–0.5% by weight of the fluorochemical.

14. The method of claim 12 wherein the said aqueous solution contains about 1% by weight of the soil release polymer and about 0.25% by weight of the water soluble polyvinylpyrrolidone, and the said aqueous medium contains about 0.2% by weight of the fluorochemical.

15. The method of claim 12 wherein the said soil release polymer is a copolymer of methyl vinyl ether and maleic anhydride.

* * * * *